US007322410B2

(12) United States Patent
Vinegar et al.

(10) Patent No.: US 7,322,410 B2
(45) Date of Patent: Jan. 29, 2008

(54) CONTROLLABLE PRODUCTION WELL PACKER

(75) Inventors: Harold J. Vinegar, Bellaire, TX (US); Robert Rex Burnett, Katy, TX (US); William Mountjoy Savage, Houston, TX (US); Frederick Gordon Carl, Jr., Houston, TX (US); John Michele Hirsch, Houston, TX (US); George Leo Stegemeier, Houston, TX (US); Ronald Marshall Bass, Houston, TX (US)

(73) Assignee: Shell Oil Company, Houston, TX (US)

( * ) Notice: Subject to any disclaimer, the term of this patent is extended or adjusted under 35 U.S.C. 154(b) by 504 days.

(21) Appl. No.: 10/220,252

(22) PCT Filed: Mar. 2, 2001

(86) PCT No.: PCT/US01/06984

§ 371 (c)(1),
(2), (4) Date: Aug. 29, 2002

(87) PCT Pub. No.: WO01/65067

PCT Pub. Date: Sep. 7, 2001

(65) Prior Publication Data

US 2003/0042026 A1 Mar. 6, 2003

(51) Int. Cl.
*E21B 43/12* (2006.01)

(52) U.S. Cl. ..... 166/250.15; 166/66.6; 166/373

(58) Field of Classification Search ..... 166/250.01, 166/250.15, 372, 373, 65.1, 66.6
See application file for complete search history.

(56) References Cited

U.S. PATENT DOCUMENTS

| | | | | |
|---|---|---|---|---|
| 525,663 | A | 9/1894 | Mottinger | |
| 2,083,321 | A | 6/1937 | Dunn et al. | 106/34 |
| 2,379,800 | A | 7/1945 | Hare | 175/356 |
| 2,414,719 | A | 1/1947 | Cloud | 178/44 |
| 2,917,004 | A | 12/1959 | Davis et al. | 103/233 |
| 3,083,771 | A | 4/1963 | Chapman | 166/146 |
| 3,087,545 | A | 4/1963 | O'Brien | 166/39 |
| 3,247,904 | A | 4/1966 | Wakefield, Jr. | 166/116 |
| 3,427,989 | A | 2/1969 | Bostock et al. | 103/232 |
| 3,465,273 | A | 9/1969 | Brock | 336/62 |
| 3,566,963 | A | 3/1971 | Blackledge | |
| 3,602,305 | A | 8/1971 | Kisling, III | |

(Continued)

FOREIGN PATENT DOCUMENTS

EP 28296 5/1981

(Continued)

OTHER PUBLICATIONS

Brown, Connolizo and Robertson, West Texas Oil Lifting Short Course and H.W. Winkler, "Misunderstood or overlooked Gas-Lift Design and Equipment Considerations," SPE, pp. 351-368 (1994).

(Continued)

*Primary Examiner*—William Neuder

(57) ABSTRACT

An apparatus and method for operating an electrically powered device in a packer using the piping structure of the well as an electrical conductor for providing power and/or communications. The electrically powered device may comprise an electrically controllable valve, a communications and control module, a modem, a sensor, and/or a tracer injection module.

21 Claims, 2 Drawing Sheets

U.S. PATENT DOCUMENTS 3,659,336 A 5/1972 Horne ..... 29/605
3,732,728 A 5/1973 Fitzpatrick ..... 73/151
3,793,632 A 2/1974 Still ..... 340/18
3,814,545 A 6/1974 Waters ..... 417/90
3,837,618 A 9/1974 Juhel ..... 251/129
3,980,826 A 9/1976 Widmer ..... 178/68
4,068,717 A 1/1978 Needham ..... 166/272
4,087,781 A 5/1978 Grossi et al. ..... 340/18
4,295,795 A 10/1981 Gass et al. ..... 417/111
4,350,205 A 9/1982 Goldschild et al. ..... 166/375
4,393,485 A 7/1983 Redden ..... 367/25
4,468,665 A 8/1984 Thawley et al. ..... 340/856
4,545,731 A 10/1985 Canalizo et al. ..... 417/86
4,566,534 A 1/1986 Going, III ..... 166/66.4
4,576,231 A 3/1986 Dowling et al. ..... 166/248
4,578,675 A 3/1986 MacLeod ..... 340/855
4,596,516 A 6/1986 Scott et al. ..... 417/58
4,630,243 A 12/1986 MacLeod ..... 367/82
4,648,471 A 3/1987 Bordon ..... 175/4.55
4,662,437 A 5/1987 Renfro ..... 166/65.1
4,681,164 A 7/1987 Stacks ..... 166/304
4,709,234 A 11/1987 Forehand et al. ..... 340/856
4,738,313 A 4/1988 McKee ..... 166/372
4,739,325 A 4/1988 MacLeod ..... 340/854
4,771,635 A 9/1988 Trevillion ..... 73/155
4,790,375 A 12/1988 Bridges et al. ..... 166/60
4,793,414 A 12/1988 Nguyen et al. ..... 166/252
4,839,644 A 6/1989 Safinya et al. ..... 340/854
4,852,648 A 8/1989 Akkerman et al. ..... 166/66.4
4,886,114 A 12/1989 Perkins et al. ..... 166/65.1
4,901,069 A 2/1990 Veneruso ..... 340/853
4,933,640 A 6/1990 Kuckes ..... 324/339
4,972,704 A 11/1990 Wellington et al. ..... 73/155
4,981,173 A 1/1991 Perkins et al. ..... 166/66.4
5,001,675 A 3/1991 Woodward ..... 367/13
5,008,664 A 4/1991 More et al. ..... 340/854
5,031,697 A 7/1991 Wellington et al. ..... 166/250
5,034,371 A 7/1991 Tanaka et al. ..... 503/227
5,130,706 A 7/1992 Van Steenwyk ..... 340/854.6
5,134,285 A 7/1992 Perry et al. ..... 250/269
5,160,925 A 11/1992 Dailey et al. ..... 340/853.3
5,162,740 A 11/1992 Jewell ..... 324/347
5,172,717 A 12/1992 Boyle et al. ..... 137/155
5,176,164 A 1/1993 Boyle ..... 137/155
5,191,326 A 3/1993 Montgomery ..... 340/855.5
5,216,285 A 6/1993 Hilsenteger et al. ..... 307/12
5,230,383 A 7/1993 Pringle et al. ..... 166/66.4
5,236,048 A 8/1993 Skinner et al. ..... 166/382
5,246,860 A 9/1993 Hutchins et al. ..... 436/27
5,251,328 A 10/1993 Shaw ..... 455/73
5,257,663 A 11/1993 Pringle et al. ..... 166/66.4
5,267,469 A 12/1993 Espinoza ..... 73/40.5
5,278,758 A 1/1994 Perry et al. ..... 364/422
5,291,947 A * 3/1994 Stracke ..... 166/187
5,326,970 A 7/1994 Bayless ..... 250/269
5,331,318 A 7/1994 Montgomery ..... 340/855.4
5,353,627 A 10/1994 Diatschenko et al. ..... 73/19.03
5,358,035 A 10/1994 Grudzinski ..... 166/53
5,367,694 A 11/1994 Ueno ..... 395/800
5,394,141 A 2/1995 Soulier ..... 340/854.4
5,396,232 A 3/1995 Mathieu et al. ..... 340/854.5
5,425,425 A 6/1995 Bankston et al. ..... 166/377
5,447,201 A 9/1995 Mohn ..... 166/375
5,458,200 A 10/1995 Lagerlef et al. ..... 166/372
5,467,083 A 11/1995 McDonald et al. ..... 340/854.6
5,473,321 A 12/1995 Goodman et al. ..... 340/854.9
5,493,288 A 2/1996 Henneuse ..... 340/854.4
5,531,270 A 7/1996 Fletcher et al. ..... 166/53
5,535,828 A 7/1996 der Kinderen et al. ..... 166/372
5,561,245 A 10/1996 Georgi et al. ..... 73/152.02
5,574,374 A 11/1996 Thompson et al. ..... 324/338
5,576,703 A 11/1996 MacLeod et al. ..... 340/854.4
5,587,707 A 12/1996 Dickie et al. ..... 340/870.09
5,592,438 A 1/1997 Rorden et al. ..... 367/83
5,662,165 A 9/1997 Tubel et al. ..... 166/250.01
5,721,538 A 2/1998 Tubel et al. ..... 340/856.1
5,723,781 A 3/1998 Pruett et al. ..... 73/152.18
5,730,219 A 3/1998 Tubel et al. ..... 66/250.01
5,745,047 A 4/1998 Van Gisbergen et al. 340/853.1
5,782,261 A 7/1998 Becker et al. ..... 137/155
5,797,453 A 8/1998 Hisaw ..... 166/117.5
5,881,807 A 3/1999 Boe et al. ..... 166/100
5,883,516 A 3/1999 Van Steenwyk et al. .... 324/366
5,887,657 A 3/1999 Bussear et al. ..... 166/336
5,896,924 A 4/1999 Carmody et al. ..... 166/53
5,934,371 A 8/1999 Bussear et al. ..... 166/53
5,937,945 A 8/1999 Bussear et al. ..... 166/250.15
5,941,307 A 8/1999 Tubel ..... 166/313
5,942,990 A 8/1999 Smith et al. ..... 340/853.7
5,955,666 A 9/1999 Mullins ..... 73/152.18
5,959,499 A 9/1999 Khan et al. ..... 330/149
5,960,883 A 10/1999 Tubel et al. ..... 166/313
5,963,090 A 10/1999 Fukuchi ..... 330/149
5,971,072 A 10/1999 Huber et al. ..... 166/297
5,975,204 A 11/1999 Tubel et al. ..... 166/250.15
5,975,504 A 11/1999 Nutter et al. ..... 261/114.3
5,995,020 A 11/1999 Owens et al. ..... 340/854.9
6,012,015 A 1/2000 Tubel ..... 702/6
6,012,016 A 1/2000 Bilden et al. ..... 702/12
6,016,845 A * 1/2000 Quigley et al. ..... 138/125
6,037,767 A 3/2000 Crescenzo et al. ..... 324/220
6,061,000 A 5/2000 Edwards ..... 340/854.6
6,070,608 A 6/2000 Pringle ..... 137/155
6,089,322 A 7/2000 Kelley et al. ..... 166/370
6,123,148 A 9/2000 Oneal ..... 166/118
6,128,508 A 10/2000 Francisco et al. ..... 455/552
6,148,915 A 11/2000 Mullen et al. ..... 166/278
6,189,621 B1 2/2001 Vail, III ..... 166/385
6,192,983 B1 2/2001 Neuroth et al. ..... 166/250.15
6,208,586 B1 3/2001 Rorden et al. ..... 367/35
6,310,534 B1 10/2001 Brunner ..... 336/174
6,334,486 B1 1/2002 Carmody et al. ..... 166/53
6,344,781 B1 2/2002 Slenker ..... 333/181
6,348,876 B1 2/2002 Wei et al. ..... 340/854.9
6,349,766 B1 2/2002 Bussear et al. ..... 166/113
6,352,109 B1 3/2002 Buckman, Sr. ..... 166/250.03
6,420,976 B1 7/2002 Baggs et al. ..... 340/853.3
6,429,784 B1 8/2002 Beigue et al. ..... 340/853.2
6,443,228 B1 9/2002 Aronstam et al. ..... 166/250.11
6,445,307 B1 9/2002 Rassi et al. ..... 340/854.6
6,464,004 B1 10/2002 Crawford et al. ..... 166/250.01
6,484,800 B2 11/2002 Carmody et al. ..... 166/53
6,515,592 B1 2/2003 Babour et al. ..... 340/854.4
6,588,505 B2 * 7/2003 Beck et al. ..... 166/250.17
6,633,164 B2 10/2003 Vinegar et al. ..... 324/355
6,633,236 B2 10/2003 Vinegar et al. ..... 340/854.4
6,662,875 B2 * 12/2003 Bass et al. ..... 166/369
6,737,951 B1 5/2004 Decristofaro et al. ..... 336/234
6,747,569 B2 6/2004 Hill et al. ..... 340/855.8
6,817,412 B2 11/2004 Haase ..... 166/250.01
2001/0002621 A1 * 6/2001 Vaynshteyn et al. ..... 166/387
2002/0017387 A1 * 2/2002 Ringgenberg et al. . 166/250.17
2003/0047317 A1 * 3/2003 Powers ..... 166/373
2003/0056952 A1 3/2003 Stegemeier et al. ... 166/250.12
2003/0086652 A1 5/2003 Boudreau et al. ..... 385/49
2003/0131991 A1 7/2003 Hartog et al. ..... 166/250.12

FOREIGN PATENT DOCUMENTS

EP 295178 A2 12/1988
EP 339825 A1 4/1989
EP 492856 A2 7/1992
EP 641916 3/1995
EP 681090 A2 11/1995

| | | | |
|---|---|---|---|
| EP | 0 697 500 | A2 | 2/1996 |
| EP | 0 721 053 | A1 | 7/1996 |
| EP | 732053 | A1 | 9/1996 |
| EP | 919696 | A2 | 6/1999 |
| EP | 922835 | A2 | 6/1999 |
| EP | 930518 | A2 | 7/1999 |
| EP | 0 964 134 | A2 | 12/1999 |
| EP | 972909 | A2 | 1/2000 |
| EP | 999341 | A2 | 5/2000 |
| EP | 1352416 | | 10/2003 |
| FR | 2677134 | | 12/1992 |
| GB | 2083321 | A | 3/1982 |
| GB | 2325949 | A | 2/1999 |
| GB | 2327695 | A | 2/1999 |
| GB | 2338253 | A | 12/1999 |
| GB | 01/20126 | A2 | 3/2001 |
| RU | 2129208 | | 4/1999 |
| WO | 80/00727 | | 4/1980 |
| WO | 93/26115 | | 12/1993 |
| WO | 96/00836 | | 1/1996 |
| WO | 96/24747 | | 8/1996 |
| WO | 97/16751 | | 5/1997 |
| WO | 97 37103 | | 10/1997 |
| WO | 98 20233 | | 5/1998 |
| WO | 99/37044 | | 7/1999 |
| WO | 99/57417 | | 11/1999 |
| WO | 99/60247 | | 11/1999 |
| WO | 00 04275 | | 1/2000 |
| WO | 00/37770 | | 6/2000 |
| WO | 01/55555 | A1 | 8/2001 |
| WO | 01/65718 | A2 | 9/2001 |

OTHER PUBLICATIONS

Der Spek, Alex, and Aliz Thomas, "Neural-Net Identification of Flow Regime with Band Spectra of Flow-Generated Sound", SPE Reservoir Eva. & Eng.2 (6) Dec. 1999, pp. 489-498.

Sakata et al., "Performance Analysis of Long Distance Transmitting of Magnetic Signal on Cylindrical Steel Rod", IEEE Translation Journal on magnetics in Japan, vol. 8, No. 2. Feb. 1993, pp. 102-106.

Otis Engineering, Aug. 1980, "Heavy Crude Lift System", Field Development Report, OEC 5228, Otis Corp., Dallas, Texas, 1980.

U.S. Appl. No. 10/220,254, filed Aug. 29, 2002, Office Action—dated Sep. 19, 2005, Inventor, John M. Hirsch.

U.S. Appl. No. 10/220,254, filed Aug. 29, 2002, Office Action—dated Apr. 6, 2005, Inventor, John M. Hirsch.

U.S. Appl. No. 10/220,455, filed Aug. 29, 2002, Office Action—dated May 18, 2004, Inventor, John M. Hirsch.

U.S. Appl. No. 10/220,455, filed Aug. 29, 2002, Office Action—dated Nov. 19, 2003, Inventor, John M. Hirsch.

U.S. Appl. No. 09/768,705, filed Jan. 24, 2001, Office Action—dated Oct. 24, 2003, Inventor, Harold J. Vinegar.

U.S. Appl. No. 09/768,705, filed Jan. 24, 2001, Office Action—dated Feb. 21, 2003, Inventor, Harold J. Vinegar.

U.S. Appl. No. 09/768,705, filed Feb. 28, 2002, Office Action—dated Oct. 24, 2003, Inventor, Harold J. Vinegar.

U.S. Appl. No. 09/769,048, filed Jan. 24, 2001, Office Action—dated Sep. 22, 2003, Inventor, Ronald M. Bass.

U.S. Appl. No. 10/220,252, filed Aug. 29, 2002, Office Action—dated Sep. 22, 2005, Inventor, Harold J. Vinegar.

U.S. Appl. No. 10/220,252, filed Aug. 29, 2002, Office Action—dated Jul. 7, 2005, Inventor, Harold J. Vinegar.

U.S. Appl. No. 10/220,252, filed Aug. 29, 2002, Office Action—dated Aug. 13, 2004, Inventor, Harold J. Vinegar.

U.S. Appl. No. 10/220,252, filed Aug. 29, 2002, Office Action—dated Jan. 2, 2004, Inventor, Harold J. Vinegar.

U.S. Appl. No. 10/220,195, filed Aug. 28, 2002, Office Action—dated Jan. 13, 2005, Inventor, Harold J. Vinegar.

U.S. Appl. No. 10/220,195, filed Aug. 28, 2002, Office Action—dated Sep. 13, 2004, Inventor, Harold J. Vinegar.

U.S. Appl. No. 10/220,195, filed Aug. 28, 2002, Office Action—dated Jun. 3, 2004, Inventor, Harold J. Vinegar.

U.S. Appl. No. 10/220,195, filed Aug. 28, 2002, Office Action—dated Nov. 12, 2003, Inventor, Harold J. Vinegar.

U.S. Appl. No. 10/220,253, filed Aug. 29, 2002, Office Action—dated Apr. 8, 2005, Inventor, John M. Hirsch.

* cited by examiner

FIG. 2
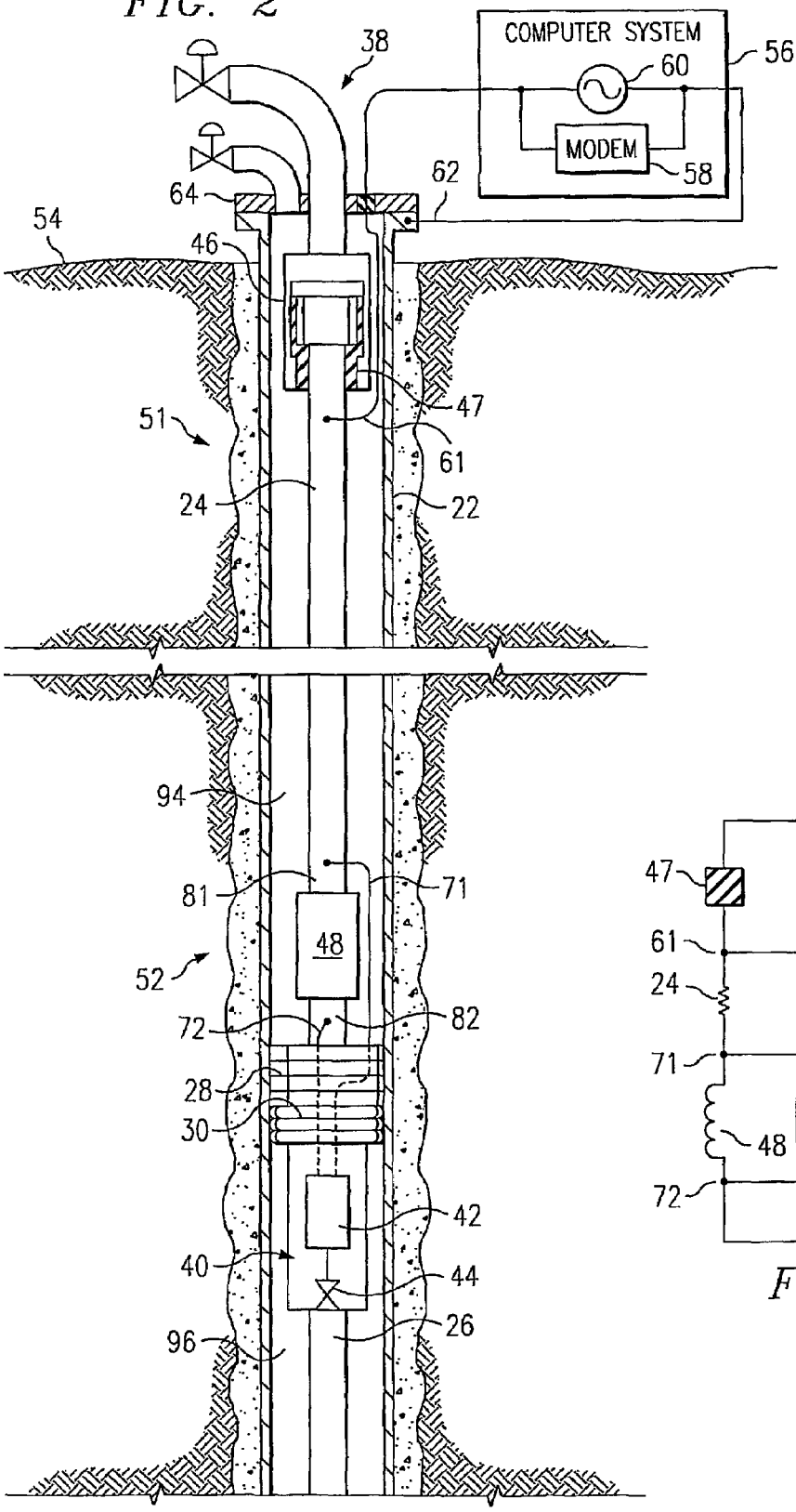
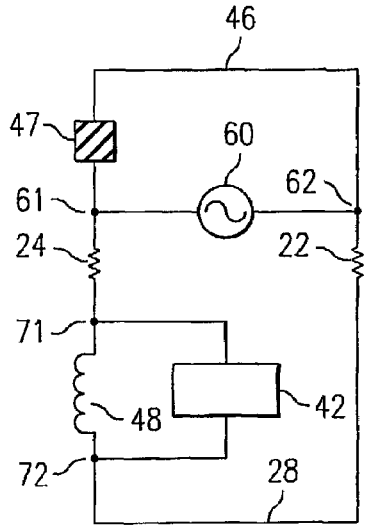
FIG. 3

CONTROLLABLE PRODUCTION WELL PACKER

CROSS-REFERENCES TO RELATED APPLICATIONS

This application claims the benefit of the following U.S. Provisional Applications, all of which are hereby incorporated by reference:

COMMONLY OWNED AND PREVIOUSLY FILED U.S. PROVISIONAL PATENT APPLICATIONS

| T&K # | Ser. No. | Title | Filing Date |
|---|---|---|---|
| TH 1599 | 60/177,999 | Toroidal Choke Inductor for Wireless Communication and Control | Jan. 24, 2000 |
| TH 1600 | 60/178,000 | Ferromagnetic Choke in Wellhead | Jan. 24, 2000 |
| TH 1602 | 60/178,001 | Controllable Gas-Lift Well and Valve | Jan. 24, 2000 |
| TH 1603 | 60/177,883 | Permanent, Downhole, Wireless, Two-Way Telemetry Backbone Using Redundant Repeater, Spread Spectrum Arrays | Jan. 24, 2000 |
| TH 1668 | 60/177,998 | Petroleum Well Having Downhole Sensors, Communication, and Power | Jan. 24, 2000 |
| TH 1669 | 60/177,997 | System and Method for Fluid Flow Optimization | Jan. 24, 2000 |
| TS 6185 | 60/181,322 | A Method and Apparatus for the Optimal Predistortion of an Electromagnetic Signal in a Downhole Communications System | Feb. 9, 2000 |
| TH 1599x | 60/186,376 | Toroidal Choke Inductor for Wireless Communication and Control | Mar. 2, 2000 |
| TH 1600x | 60/186,380 | Ferromagnetic Choke in Wellhead | Mar. 2, 2000 |
| TH 1601 | 60/186,505 | Reservoir Production Control from Intelligent Well Data | Mar. 2, 2000 |
| TH 1671 | 60/186,504 | Tracer Injection in a Production Well | Mar. 2, 2000 |
| TH 1672 | 60/186,379 | Oilwell Casing Electrical Power Pick-Off Points | Mar. 2, 2000 |
| TH 1673 | 60/186,394 | Controllable Production Well Packer | Mar. 2, 2000 |
| TH 1674 | 60/186,382 | Use of Downhole High Pressure Gas in a Gas Lift Well | Mar. 2, 2000 |
| TH 1675 | 60/186,503 | Wireless Smart Well Casing | Mar. 2, 2000 |
| TH 1677 | 60/186,527 | Method for Downhole Power Management Using Energization from Distributed Batteries or Capacitors with Reconfigurable Discharge | Mar. 2, 2000 |
| TH 1679 | 60/186,393 | Wireless Downhole Well Interval Inflow and Injection Control | Mar. 2, 2000 |
| TH 1681 | 60/186,394 | Focused Through-Casing Resistivity Measurement | Mar. 2, 2000 |
| TH 1704 | 60/186,531 | Downhole Rotary Hydraulic Pressure for Valve Actuation | Mar. 2, 2000 |
| TH 1705 | 60/186,377 | Wireless Downhole Measurement and Control For Optimizing Gas Lift Well and Field Performance | Mar. 2, 2000 |
| TH 1722 | 60/186,381 | Controlled Downhole Chemical Injection | Mar. 2, 2000 |
| TH 1723 | 60/186,378 | Wireless Power and Communications Cross-Bar Switch | Mar. 2, 2000 |

The current application shares some specification and figures with the following commonly owned and concurrently filed applications, all of which are hereby incorporated by reference:

COMMONLY OWNED AND CONCURRENTLY FILED U.S PATENT APPLICATIONS

| T&K # | Ser. No. | Title | Filing Date |
|---|---|---|---|
| TH 1601US | 60/186505 | Reservoir Production Control from Intelligent Well Data | |
| TH 1671US | 60/186504 | Tracer Injection in a Production Well | |
| TH 1672US | 60/186379 | Oil Well Casing Electrical Power Pick-Off Points | |
| TH 1674US | 60/186382 | Use of Downhole High Pressure Gas in a Gas-Lift Well | |
| TH 1675US | 60/186503 | Wireless Smart Well Casing | |
| TH 1677US | 60/186527 | Method for Downhole Power Management Using Energization from Distributed Batteries or Capacitors with Reconfigurable Discharge | |
| TH 1679US | 60/186393 | Wireless Downhole Well Interval Inflow and Injection Control | |
| TH 1681US | 60/184394 | Focused Through-Casing Resistivity Measurement | |
| TH 1704US | 60/186531 | Downhole Rotary Hydraulic Pressure for Valve Actuation | |
| TH 1705US | 60/186377 | Wireless Downhole Measurement and Control For Optimizing Gas Lift Well and Field Performance | |
| TN 1722US | 60/186381 | Controlled Downhole Chemical Injection | |
| TH 1723US | 60/186378 | Wireless Power and Communications Cross-Bar Switch | |

The current application shares some specification and figures with the following commonly owned and previously filed applications, all of which are hereby incorporated by reference:

COMMONLY OWNED AND PREVIOUSLY FILED U.S PATENT APPLICATIONS

| T&K # | Ser. No. | Title | Filing Date |
|---|---|---|---|
| TH 1599US | 09/769047 | Choke Inductor for Wireless Communication and Control | |
| TH 1600US | 60/178000 | Induction Choke for Power Distribution in Piping Structure | |
| TH 1602US | 60/178001 | Controllable Gas-Lift Well and Valve | |
| TH 1603US | 10/645276 | Permanent Downhole, Wireless, Two-Way Telemetry Backbone Using Redundant Repeater | |
| TH 1668US | 60/177998 | Petroleum Well Having Downhole Sensors, Communication, and Power | |
| TH 1669US | 60/177997 | System and Method for Fluid Flow Optimization | |
| TH 1783US | 60/263932 | Downhole Motorized Flow Control Valve | |
| TS 6185US | 09/779935 | A Method and Apparatus for the Optimal Predistortion of an Electro Magnetic Signal in a Downhole Communications System | |

The benefit of 35 U.S.C. § 120 is claimed for all of the above referenced commonly owned applications. The applications referenced in the tables above are referred to herein as the "Related Applications."

BACKGROUND OF THE INVENTION

1. Field of the Invention

The present invention relates to a controllable production well packer. In one aspect, it relates to a petroleum production well packer comprising an electrically powered device, in which the device may comprise an electrically controllable valve, a communications and control module, a sensor, a modem, a tracer injection module, or any combination thereof.

2. Description of the Related Art

Petroleum wells (e.g., oil and/or gas wells) typically pass through formations containing multiple zones that may produce differing fluids, as well as impermeable zones. The fluid-bearing zones may produce saline or clear water, oil, gas, or a mixture of these components.

It is desirable and customary to maintain hydraulic isolation between zones so that the fluids produced from each zone may be received separately at the surface. Even if a particular zone is not producing petroleum products, it is usually necessary to ensure that fluids from that zone do not travel to other zones using the wellbore as a transport path, and to avoid contamination of the fluids in each zone.

The necessary isolation between zones is often provided by packers. A typical hydraulically set production packer of the prior art is schematically shown in FIG. 1. Packers are mechanical devices that close the annulus between the production tubing and the casing, and seal to both. Packers are typically installed at the time of well completion by attaching them to a tubing string as it is lowered into the well. Thus, during placement, the packer must pass freely within the casing. Once it is in place, a hydraulic actuator (energized and controlled from the surface) operates the sealing mechanism of the packer, which clamps the packer to the casing and effects a fluid-tight seal in the annular space between the tubing and the casing.

Packers may provide complete isolation between the annular spaces above and below them, or may be equipped with one or more preset mechanically-actuated valves to control flow past them. When control valves are included, however, their settings can only be altered by mechanically inserting a slick-line tool, which is inconvenient, slow, and relatively costly. Additionally, when there are multiple zones and multiple packers it is often impossible or impractical to reach the lowermost packers with a slick-line tool. This lack of a fast and inexpensive method for controlling valves in a packer is a constraint on well design and production operations.

Conventional packers are known such as described in U.S. Pat. Nos. 6,148,915, 6,123,148, 3,566,963 and 3,602,305.

All references cited herein are incorporated by reference to the maximum extent allowable by law. To the extent a reference may not be fully incorporated herein, it is incorporated by reference for background purposes, and indicative of the knowledge of one of ordinary skill in the art.

BRIEF SUMMARY OF THE INVENTION

The problems and needs outlined above are largely solved and met by the present invention. In accordance with one aspect of the present invention, a packer adapted for use in a petroleum well, wherein the packer comprises an electrically powered device, is provided. The electrically powered device may comprise an electrically controllable valve adapted to control fluid communication from one side of the packer to another side of the packer when the packer is operably installed. The electrically powered device may further comprise a communications and control module being electrically connected to the electrically controllable valve, wherein the module comprises a modem adapted to receive control commands encoded within communication signals. The module can be adapted to decode the control commands received by the modem and control the movement of the valve using the control commands when the packer is operably installed. Alternatively, the electrically powered device may comprise a sensor adapted to detect at least one physical characteristic of a surrounding environment and generate data corresponding to the physical characteristic, as well as a modem adapted to receive the data from the sensor and electrically transmit the data in the form of an electrical communication signal. Hence, the electrically powered device can comprise an electrically controllable valve, a sensor, a modem, a communications and control module, a tracer injection module, or any combination thereof.

In accordance with another aspect of the present invention, a petroleum production well incorporating the packer described above is provided. The petroleum well comprises a piping structure, a source of time-varying current, an electrical return, an induction choke, and the packer. The piping structure of the well comprises an electrically conductive portion extending along at least part of the piping structure. The piping structure can comprise a production tubing string of the well. The source of time-varying current comprises two source terminals. A first of the source terminals is electrically connected to the electrically conductive portion of the piping structure. The electrical return electrically connects between the electrically conductive portion of the piping structure and a second of the source terminals of the time-varying current source. The electrical return can comprise a well casing of the well, part of the packer, another packer, and/or a conductive fluid within the well. The induction choke is located about part of the electrically conductive portion of the piping structure at a location along the piping structure between the electrical connection location for the first source terminal and the electrical connection location for the electrical return, such that a voltage potential is formed between the electrically conductive portion of the piping structure on a source-side of the induction choke, and the electrically conductive portion of the piping structure on an electrical-return-side of the induction choke as well as the electrical return when time-varying current flows through the electrically conductive portion of the piping structure. The induction choke can comprise a ferromagnetic material. Also, the induction choke need not be powered when its size, geometry, and magnetic properties can provide sufficient magnetic inductance for developing the voltage potential desired. The electrically powered device of the packer is electrically connected across the voltage potential such that part of the time-varying current is routed through the device due to the induction choke when the time-varying current flows through the electrically conductive portion of the piping structure.

In accordance with yet another aspect of the present invention, a method of producing petroleum products from a petroleum well comprising an electrically powered packer is provided.

A conventional petroleum well includes a cased wellbore having a tubing string positioned within and longitudinally extending within the casing. In a preferred embodiment, a controllable packer is coupled to the tubing to provide a seal of the annular space between the tubing and casing. A valve in the packer (and/or other devices, such as sensors) is powered and controlled from the surface. Communication signals and power are sent from the surface using the tubing and casing as conductors. At least one induction choke is coupled about the tubing downhole to magnetically inhibit alternating current flow through the tubing at a choke. An insulating tubing joint, another induction choke, or another insulating means between the tubing and casing can be located at the surface above a location where current and communication signals are imparted to the tubing. Hence, most of the alternating current is contained between the downhole choke and the insulating tubing joint, or between the chokes when two chokes are used.

The Related Applications describe alternative ways to provide electrical power from the surface to downhole modules, and to establish bidirectional communications for data and commands to be passed between the surface and downhole modules using surface and downhole modems. A preferred embodiment utilizes the production tubing and the well casing as the electrical conduction path between the surface and downhole equipment. The cost reduction and simplification of installation procedures which accrue from obviating the need for electrical cables to provide power, sensing, and control functions downhole allow wider deployment of active equipment downhole during production.

In the context of downhole packers, the ability to power and communicate with the packer has many advantages. Such a controllable packer in accordance with the present invention may incorporate sensors, with data from the sensors being received in real time at the surface. Similarly, the availability of power downhole, and the ability to pass commands from the surface to the controllable packer, allow electrically motorized mechanical components, such as flow control valves, to be included in packer design, thus increasing their flexibility in use. Notably, the control of such components in the controllable packer hereof is near real time, allowing packer flow control valves to be opened, closed, adjusted, or throttled constantly to contribute to the management of production.

In a preferred embodiment, a surface computer having a master modem can impart a communication signal to the tubing, and the communication signal is received at a slave modem downhole, which is electrically connected to or within the controllable packer. The communication signal can be received by the slave modem either directly or indirectly via one or more relay modems. Further, electric power can be input into the tubing string and received downhole to power the operation of sensors or other devices in the controllable packer. Preferably, the casing is used as a conductor for the electrical return.

In a preferred embodiment, a controllable valve in the packer regulates the fluid communication in the annulus between the casing and tubing. The electrical return path can be provided along part of the controllable packer, and preferably by the expansion of the expansion slips into contact with the casing. Alternatively, the electrical return path may be via a conductive centralizer around the tubing which is insulated in its contact with the tubing, but is in electrical contact with the casing and electrically connected to the device in the packer.

In enhanced forms, the controllable packer includes one or more sensors downhole which are preferably in contact with the downhole modem and communicate with the surface computer via the tubing and/or well casing. Such sensors as temperature, pressure, acoustic, valve position, flow rates, and differential pressure gauges can be advantageously used in many situations. The sensors supply measurements to the modem for transmission to the surface or directly to a programmable interface controller operating a downhole device, such as controllable valve for controlling the fluid flow through the packer.

In one embodiment, ferromagnetic induction chokes are coupled about the tubing to act as a series impedance to current flow on the tubing. In a preferred form, an upper ferromagnetic choke. is placed around the tubing below the casing hanger, and the current and communication signals are imparted to the tubing below the upper ferromagnetic choke. A lower ferromagnetic choke is placed downhole around the tubing with the controllable packer electrically coupled to the tubing above the lower ferromagnetic choke, although the controllable packer may be mechanically coupled to the tubing below the lower ferromagnetic choke instead.

Preferably, a surface computer is coupled via a surface master modem and the tubing to the downhole slave modem of the controllable packer. The surface computer can receive measurements from a variety of sources (e.g., downhole sensors), measurements of the oil output from the well, and measurements of the compressed gas input to the well in the case of a gas lift well. Using such measurements, the computer can compute desired positions of the controllable valve in the packer, and more particularly, the optimum amount of fluid communication to permit into the annulus inside the casing.

Construction of such a petroleum well is designed to be as similar to conventional construction methodology as possible. That is, after casing the well, a packer is typically set to isolate each zone. In a production well, there may be several oil producing zones, water producing zones, impermeable zones, and thief zones. It is desirable to prevent or permit communication between the zones. For example when implementing the present invention, the tubing string is fed through the casing into communication with the production zone, with controllable packers defining the production zone. As the tubing string is made up at the surface, a lower ferromagnetic choke is placed around one of the conventional tubing strings for positioning above the lowermost controllable packer. In the sections of the tubing strings where it is desired, another packer is coupled to the tubing string to isolate zones. Controllable gas lift valves or sensor pods also may be coupled to the tubing as desired by insertion in a side pocket mandrel (tubing conveyed) and corresponding induction chokes as needed. The tubing string is made up to the surface where an upper ferromagnetic induction choke is again placed around the tubing string below the casing hanger. Communication and power leads are then connected to the tubing string below the upper choke. In an enhanced form, an electrically insulating joint is used instead of the upper induction choke.

A sensor and communication pod can be incorporated into the controllable packer of the present invention without the necessity of including a controllable valve or other control device. That is, an electronics module having pressure, temperature or acoustic sensors, power supply, and a modem can be incorporated into the packer for communication to the surface computer using the tubing and casing as conductors.

BRIEF DESCRIPTION OF THE DRAWINGS

Other objects and advantages of the invention will become apparent upon reading the following detailed description and upon referencing the accompanying drawings, in which:

FIG. 2 is a schematic showing a petroleum production well in accordance with a preferred embodiment of the present invention;

FIG. 3 is a simplified electrical schematic of the embodiment shown in FIG. 2.

DETAILED DESCRIPTION OF THE INVENTION

Figure 1:
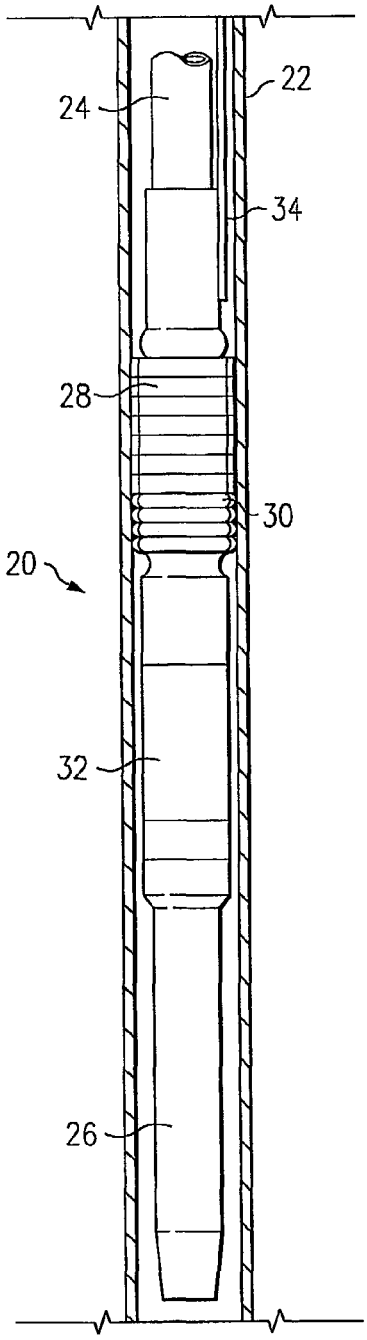
FIG. 1 (PRIOR ART)
FIG. 1 is a schematic showing a typical packer of the prior art.

Referring now to the drawings, wherein like reference numbers are used herein to designate like elements throughout the various views, a preferred embodiment of the present invention is illustrated and further described, and other possible embodiments of the present invention are described. The figures are not necessarily drawn to scale, and in some instances the drawings have been exaggerated and/or simplified in places for illustrative purposes only. One of ordinary skill in the art will appreciate the many possible applications and variations of the present invention based on the following examples of possible embodiments of the present invention, as well as based on those embodiments illustrated and discussed in the Related Applications, which are incorporated by reference herein to the maximum extent allowed by law.

As used in the present application, a "piping structure" can be one single pipe, a tubing string, a well casing, a pumping rod, a series of interconnected pipes, rods, rails, trusses, lattices, supports, a branch or lateral extension of a well, a network of interconnected pipes, or other similar structures known to one of ordinary skill in the art. The preferred embodiment makes use of the invention in the context of a petroleum well where the piping structure comprises tubular, metallic, electrically-conductive pipe or tubing strings, but the invention is not so limited. For the present invention, at least a portion of the piping structure needs to be electrically conductive, such electrically conductive portion may be the entire piping structure (e.g., steel pipes, copper pipes) or a longitudinal extending electrically conductive portion combined with a longitudinally extending non-conductive portion. In other words, an electrically conductive piping structure is one that provides an electrical conducting path from a first portion where a power source is electrically connected to a second portion where a device and/or electrical return is electrically connected. The piping structure will typically be conventional round metal tubing, but the cross-section geometry of the piping structure, or any portion thereof, can vary in shape (e.g., round, rectangular, square, oval) and size (e.g., length, diameter, wall thickness) along any portion of the piping structure. Hence, a piping structure must have an electrically conductive portion extending from a first portion of the piping structure to a second portion of the piping structure, wherein the first portion is distally spaced from the second portion along the piping structure.

Note that the terms "first portion" and "second portion" as used herein are each defined generally to call out a portion, section, or region of a piping structure that may or may not extend along the piping structure, that can be located at any chosen place along the piping structure, and that may or may not encompass the most proximate ends of the piping structure.

Similarly, in accordance with conventional terminology of oilfield practice, the descriptors "upper", "lower", "uphole" and "downhole" are relative and refer to distance along hole depth from the surface, which in deviated or horizontal wells may or may not accord with vertical elevation measured with respect to a survey datum.

Also note that the term "modem" is used herein to generically refer to any communications device for transmitting and/or receiving electrical communication signals via an electrical conductor (e.g., metal). Hence, the term "modem" as used herein is not limited to the acronym for a modulator (device that converts a voice or data signal into a form that can be transmitted)/demodulator (a device that recovers an original signal after it has modulated a high frequency carrier). Also, the term "modem" as used herein is not limited to conventional computer modems that convert digital signals to analog signals and vice versa (e.g., to send digital data signals over the analog Public Switched Telephone Network). For example, if a sensor outputs measurements in an analog format, then such measurements may only need to be modulated (e.g., spread spectrum modulation) and transmitted—hence no analog/digital conversion needed. As another example, a relay/slave modem or communication device may only need to identify, filter, amplify, and/or retransmit a signal received.

As used in the present application, "wireless" means the absence of a conventional, insulated wire conductor e.g. extending from a downhole device to the surface. Using the tubing and/or casing as a conductor is considered "wireless." The term "valve" as used herein generally refers to any device that functions to regulate the flow of a fluid. Examples of valves include, but are not limited to, bellows-type gas-lift valves and controllable gas-lift valves, each of which may be used to regulate the flow of lift gas into a tubing string of a well. The internal workings of valves can vary greatly, and in the present application, it is not intended to limit the valves described to any particular configuration, so long as the valve functions to regulate flow. Some of the various types of flow regulating mechanisms include, but are not limited to, ball valve configurations, needle valve configurations, gate valve configurations, and cage valve configurations. The methods of installation for valves discussed in the present application can vary widely.

The term "electrically controllable valve" as used herein generally refers to a "valve" (as just described) that can be opened, closed, adjusted, altered, or throttled continuously in response to an electrical control signal (e.g., signal from a surface computer or from a downhole electronic controller module). The mechanism that actually moves the valve position can comprise, but is not limited to: an electric motor; an electric servo; an electric solenoid; an electric switch; a hydraulic actuator controlled by at least one electrical servo, electrical motor, electrical switch, electric solenoid, or combinations thereof; a pneumatic actuator controlled by at least one electrical servo, electrical motor, electrical switch, electric solenoid, or combinations thereof; or a spring biased device in combination with at least one electrical servo, electrical motor, electrical switch, electric solenoid, or combinations thereof. An "electrically controllable valve" may or may not include a position feedback sensor for providing a feedback signal corresponding to the actual position of the valve.

The term "sensor" as used herein refers to any device that detects, determines, monitors, records, or otherwise senses the absolute value of or a change in a physical quantity. A sensor as described herein can be used to measure physical quantities including, but not limited to: temperature, pressure (both absolute and differential), flow rate, seismic data, acoustic data, pH level, salinity levels, valve positions, or almost any other physical data.

FIG. 1 is a schematic showing a conventional hydraulically set production packer 20 of the prior art set within a well casing 22 of a well. The packer 20 of FIG. 1 is threaded to a production tubing string 24. The conventional packer 20 has a tail piece 26 that may terminate with an open or closed end for the lowest packer in the completed well, or the tail piece 26 may be threaded onto tubing (not shown) that passes to lower regions of the well. The conventional packer 20 has a section of slips 28 and a seal section 30. Both the slips 28 and the seal section 30 can pass freely inside the well casing 22 during placement, and are operated by a hydraulic actuator 32. When the packer 20 is at its final location in the casing 22, the hydraulic actuator 32 is used to exert mechanical forces on the slips 28 and the seals 30 causing them to expand against the casing. The slips 28 lock the packer 20 in place by gripping the internal surface of the casing 22 so that the packer cannot be displaced by differential pressure between the spaces above and below the packer. The seal section 30 creates a liquid-tight seal between the spaces above and below the packer 20. The hydraulic actuator 32 is operated using high-pressure oil supplied from the surface (not shown) by a control tube 34. However, the conventional packer 20 does not comprise an electrically powered device.

FIG. 2 is a schematic showing a petroleum production well 38 in accordance with a preferred embodiment of the present invention. The petroleum production well 38 shown in FIG. 2 is similar to a conventional well in construction, but with the incorporation of the present invention. In this example, a packer 40 comprising an electrically powered device 42 is placed in the well 38 in the same manner as a conventional packer 20 would be—to separate zones in a formation. In the preferred embodiment, the electrically powered device 42 of the packer 40 comprises an electrically controllable valve 44 that acts as a bypass valve, as shown in more detail in FIG. 4 and described further below.

In a preferred embodiment, the piping structure comprises part of a production tubing string 24, and the electrical return comprises part of a well casing 22. An insulating tubing joint 46 and a ferromagnetic induction choke 48 are used in this preferred embodiment. The insulating joint 46 (or hanger) is incorporated close to the wellhead to electrically insulate the lower sections of tubing 24 from casing 22. Thus, the insulating joint 46 prevents an electrical short-circuit between the lower sections of tubing 24 and casing 22 at the tubing hanger 46. The hanger 46 provides mechanical coupling and support of the tubing 24 by transferring the weight load of the tubing 24 to the casing 22. The induction choke 48 is attached about the tubing string 24 at a second portion 52 downhole above the packer 40. A computer system 56 comprising a master modem 58 and a source of time-varying current 60 is electrically connected to the tubing string 24 below the insulating tubing joint 46 by a first source terminal 61. The first source terminal 61 is insulated from the hanger 46 where is passes through it. A second source terminal 62 is electrically connected to the well casing 22, either directly (as in FIG. 2) or via the hanger 46 (arrangement not shown). In alternative to or in addition to the insulating tubing joint 46, another induction choke (not shown) can be placed about the tubing 24 above the electrical connection location for the first source terminal 61 to the tubing.

The time-varying current source 60 provides the current, which carries power and communication signals downhole. The time-varying current is preferably alternating current (AC), but it can also be a varying direct current (DC). The communication signals can be generated by the master modem 58 and embedded within the current produced by the source 60. Preferably, the communication signal is a spread spectrum signal, but other forms of modulation could be used in alternative.

The electrically powered device 42 in the packer 40 comprises two device terminals 71, 72, and there can be other device terminals as needed for other embodiments or applications. A first device terminal 71 is electrically connected to the tubing 24 on a source-side 81 of the induction choke 48, which in this case is above the induction choke. Similarly, a second device terminal 72 is electrically connected to the tubing 24 on an electrical-return-side, 82 of the induction choke 48, which in this case is below the induction choke. In this preferred embodiment, the slips 28 of the packer 40 provide the electrical connection between the tubing 24 and the well casing 22. However, as will be clear to one of ordinary skill in the art, the electrical connection between the tubing 24 and the well casing 22 can be accomplished in numerous ways, some of which can be seen in the Related Applications, including (but not limited to): another packer (conventional or controllable); conductive fluid in the annulus between the tubing and the well casing; a conductive centralizer; or any combination thereof. Hence, an electrical circuit is formed using the tubing 24 and the well casing 22 as conductors to the downhole device 42 within the packer 40.

FIG. 3 illustrates a simplified electrical schematic of the electrical circuit formed in the well 38 of FIG. 2. The insulating tubing joint 46 and the induction choke 48 effectively create an isolated section of the tubing string 24 to contain most of the time-varying current between them. Accordinly, a voltage potential develops between the isolated section of tubing 24 and the well casing 22 when AC flows through the tubing string. Likewise, the voltage potential also forms between tubing 24 on the source-side 81 of the induction choke 48 and the tubing 24 on the electrical-return-side 82 of the induction choke 48 when AC flows through the tubing string. In the preferred embodiment, the electrically powered device 42 in the packer 40 is electrically connected across the voltage potential between the source-side 81 and the electrical-return-side 82 of the tubing 24. However in alternative, the device 42 can be electrically connected across the voltage potential between the tubing 24 and the casing 22, or the voltage potential between the tubing 24 and part of the packer 40 (e.g., slips 28), if that part of the packer is electrically contacting the well casing 22. Thus, part of the current that travels through the tubing 24 and casing 22 is routed through the device 42 due to the induction choke 48.

As is made clear by consideration of the electrical equivalent circuit diagram of FIG. 3, centralizers which are installed on the tubing between isolation device 47 and choke 48 must not provide an electrically conductive path between tubing 24 and casing 22. Suitable centralizers may be composed of solid molded or machined plastic, or may be of the bow-spring type provided these are furnished with appropriate insulating elements. Many suitable and alternative design implementations of such centralizers will be clear to those of average skill in the art.

Other alternative ways to develop an electrical circuit using a piping structure and at least one induction choke are described in the Related Applications, many of which can be applied in conjunction with the present invention to provide power and/or communications to the electrically powered device 42 of the packer 40 and to form other embodiments of the present invention.

Figure 4:
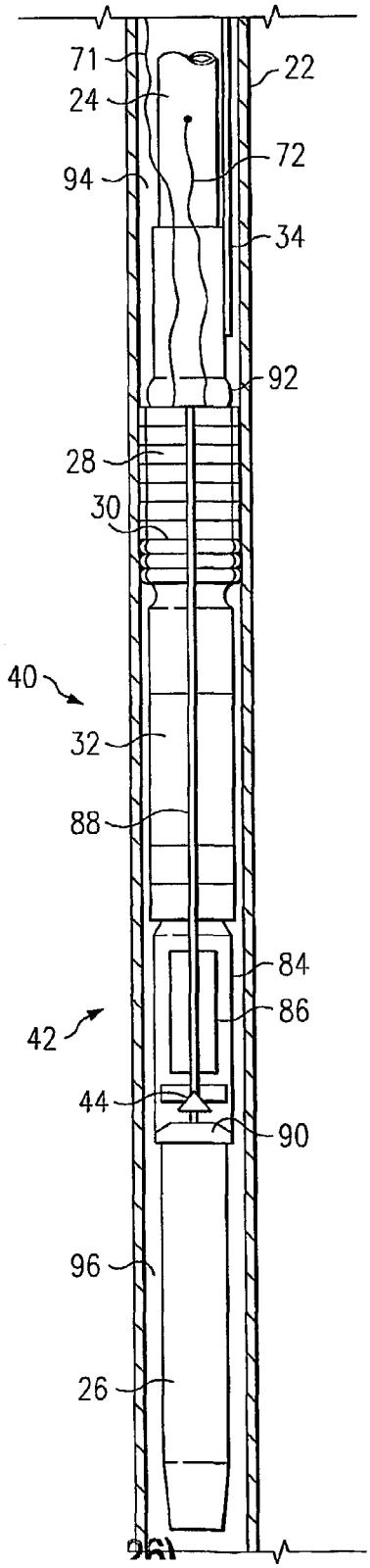
FIG. 4 is an enlarged schematic showing a controllable packer, from FIG. 2, comprising an electrically controllable valve.

Turning to FIG. 4, which shows more details of the packer 40 of FIG. 2, it is seen that the controllable packer 40 is similar to the conventional packer 20 (shown in FIG. 1), but with the addition of an electrically powered device 42 comprising an electrically controllable valve 44 and a communications and control module 84. The communications and control module 84 is powered from and communicates with the computer system 56 at the surface 54 via the tubing 24 and/or the casing 22. The communications and control module 84 may comprise a modem 86, a power transformer (not shown), a microprocessor (not shown), and/or other various electronic components (not shown) as needed for an embodiment. The communications and control module 84 receives electrical signals from the computer system 56 at the surface 54 and decodes commands for controlling the electrically controlled valve 44, which acts as a bypass valve. Using the decoded commands, the communications and control module 84 controls a low current electric motor that actuates the movement of the bypass valve 44. Thus, the valve 44 can be opened, closed, adjusted, altered, or throttled continuously by the computer system 56 from the surface 54 via the tubing 24 and well casing 22.

The bypass valve 44 of FIG. 4 controls flow through a bypass tube 88, which connects inlet and outlet ports 90, 92 at the bottom and top of the packer 40. The ports 90, 92 communicate freely with the annular spaces 94, 96 (between the casing 22 and the tubing 24), above and below the packer 40. The bypass control valve 44 therefore controls fluid exchange between these spaces 94, 96, and this exchange may be altered in real time using commands sent from the computer system 56 and received by the controllable packer 40.

The mechanical arrangement of the packer 40 depicted in FIG. 4 is illustrative, and alternative embodiments having other mechanical features providing the same functional needs of a packer (i.e., fluidly isolating and sealing one casing section from another casing section in a well, and in the case of a controllable packer, regulating and controlling fluid flow between these isolated casing sections) are possible and encompassed within the present invention. For instance, the inlet and outlet ports 90, 92 may be exchanged to pass fluids from the annular space 94 above the packer 40 to the space 96 below the packer. Also, the communications and control module 84 and the bypass control valve 44 may be located in upper portion of the packer 40, above the slips 28. The controllable packer 40 may also comprise sensors (not shown) electrically connected to or within the communication and control module 84, to measure pressures or temperatures in the annuli 94, 96 or within the production tubing 24. Hence, the measurements can be transmitted to the computer system 56 at the surface 54 using the communications and control module 84, providing real time data on downhole conditions. Also the setting and unsetting mechanism of the packer slips may be actuated by one or more motors driven and controlled by power and commands received by module 84.

In other possible embodiments of the present invention, the electrically powered device 42 of the packer 40 may comprise: a modem 86; a sensor (not shown); a microprocessor (not shown); a packer valve 44; a tracer injection module (not shown); an electrically controllable gas-lift valve (e.g., for controlling the flow of gas from the annulus to inside the tubing) (not shown); a tubing valve (e.g., for varying the flow of a tubing section, such as an application having multiple branches or laterals) (not shown); a communications and control module 84; a logic circuit (not shown); a relay modem (not shown); other electronic components as needed (not shown); or any combination thereof.

Also in other possible embodiments of the present invention, there may be multiple controllable packers and/or multiple induction chokes. In an application where there are multiple controllable packers or additional conventional packers combined with the present invention, it may be necessary to electrically insulate some or all of the packers so that a packer does not act as a short between the piping structure (e.g., tubing 24) and the electrical return (e.g., casing 22) where such a short is not desired. Such electrical insulation of a packer may be achieved in various ways apparent to one of ordinary skill in the art, including (but not limited to): an insulating sleeve about the tubing at the packer location; a rubber or urethane portion at the radial extent of the packer slips; an insulating coating on the tubing at the packer location; forming the slips from non-electrically-conductive materials; other known insulating means; or any combination thereof. The present invention also can be applied to other types of wells (other than petroleum wells), such as a water well.

It will be appreciated by those skilled in the art having the benefit of this disclosure that this invention provides a packer comprising an electrically powered device, as well as a petroleum production well incorporating such a packer. It should be understood that the drawings and detailed description herein are to be regarded in an illustrative rather than a restrictive manner, and are not intended to limit the invention to the particular forms and examples disclosed. On the contrary, the invention includes any further modifications, changes, rearrangements, substitutions, alternatives, design choices, and embodiments apparent to those of ordinary skill in the art, without departing from the spirit and scope of this invention, as defined by the following claims. Thus, it is intended that the following claims be interpreted to embrace all such further modifications, changes, rearrangements, substitutions, alternatives, design choices, and embodiments.

The invention claimed is:

1. A packer adapted for use in a well, said packer including an electrically powered device adapted for receiving AC power from the surface using at least one of the tubing or casing as a conductor;

wherein said electrically powered device comprises an electrically controllable valve adapted to control fluid communication from one side of said packer to another side of said packer;

wherein said electrically powered device further comprises a communications and control module being electrically connected to said electrically controllable valve, said module comprising a modem adapted to receive control commands encoded within communication signals, and said module being adapted to decode said control commands received by said modem and control the movement of said valve using said control commands when said packer is operably installed.

2. A packer in accordance with claim 1, wherein said electrically powered device comprises:

a sensor adapted to detect at least one physical characteristic of a surrounding environment and generate data corresponding to said physical characteristic; and a modem adapted to receive said data from said sensor and electrically transmit said data in the form of an electrical communication signal.

3. A petroleum well for producing petroleum products, comprising:

a piping structure that is electrically conductive;

a source of time-varying current electrically connected to said piping structure;

an electrical return comprising at least a portion of an earthen ground; and a packer including an electrically powered device, said electrically powered device being electrically connected potential such that part of said time-varying current is routed through said device when said time-varying current is applied through said piping structure.

4. A petroleum well in accordance with claim 3, wherein said electrically powered device comprises an electrically controllable valve adapted to control fluid communication between one side of said packer and another side of said packer when said packer is operably installed.

5. A petroleum well in accordance with claim 3, wherein said electrically powered device comprises a sensor adapted to measure a physical quantity.

6. A petroleum well in accordance with claim 3, wherein said electrically powered device comprises a modem adapted to send and receive communications along piping structure.

7. A petroleum well in accordance with claim 3, wherein said electrically powered device comprises a chemical injection module adapted to controllably inject a substance into a flow stream.

8. A petroleum well in accordance with claim 3, wherein said electrically powered device comprises an electrically controllable valve adapted to control fluid communication between an exterior and an interior of a production tubing string.

9. A petroleum well in accordance with claim 3, wherein said electrically powered device comprises an electrically controllable valve adapted to control fluid flow within a production tube.

10. A petroleum well in accordance with claim 3, wherein said piping structure comprises a production tubing string of said well.

11. A petroleum well in accordance with claim 3, wherein said piping structure comprises a well casing of said well.

12. A petroleum well in accordance with claim 3, wherein said electrical return comprises a well casing of said well.

13. A petroleum well in accordance with claim 3, further comprising a second packer.

14. A petroleum well in accordance with claim 13, wherein said second packer comprises an electrical insulator so that said piping structure is not electrically connected to said electrical return at said second packer when said second packer is operably installed.

15. A petroleum well in accordance with claim 13, wherein said second packer is part of said electrical return.

16. A petroleum well in accordance with claim 3, wherein said packer is located on said source-side of an induction choke.

17. A petroleum well in accordance with claim 3, wherein said packer is located on said electrical-return-side of said induction choke.

18. A method of operating a petroleum well comprising:

providing an electrically powered packer in a petroleum well;

providing a piping structure in said well, said piping structure;

operably installing said electrically powered packer in said well, said electrically powered packer comprising an electrically powered device, such that said device is electrically connected to said piping structure when said well is operable for petroleum production;

operably installing an induction choke about part said piping structure;

supplying time-varying current to said piping structure;

routing part of said time-varying current through said electrically powered device using said induction choke; and producing petroleum products with said well; wherein the electrically powered device is powered by a voltage differential across the induction choke.

19. A method in accordance with claim 18, further comprising the steps of:

measuring a physical quantity with said electrically powered device, wherein said electrically powered device comprises a sensor; and varying a flow of petroleum products in said well based on said measurements.

20. A method in accordance with claim 18, further comprising the step of:

electrically controlling fluid communication between sections of said well using said packer, wherein said electrically powered device composes an electrically controllable valve.

21. A petroleum well in accordance with claim 18, further comprising a second induction choke, said second induction choke being located about another part of said tubing or casing and at a location along said piping structure such that said electrical connection location for said time-varying current source is located between said induction chokes.

* * * * *